US008631961B2

(12) United States Patent
Naruse et al.

(10) Patent No.: US 8,631,961 B2
(45) Date of Patent: Jan. 21, 2014

(54) END WALL CLOSURE APPARATUS

(75) Inventors: Tomohiro Naruse, Hitachinaka (JP); Tetsuya Kuwano, Tsuchiura (JP); Taiji Hashimoto, Tsuchiura (JP); Haruo Miura, Kasumigaura (JP); Mitsuhiro Narita, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 466 days.

(21) Appl. No.: 12/765,111

(22) Filed: Apr. 22, 2010

(65) Prior Publication Data

US 2010/0270308 A1 Oct. 28, 2010

(30) Foreign Application Priority Data

Apr. 22, 2009 (JP) ..... 2009-103744

(51) Int. Cl.
*F17C 13/06* (2006.01)
*B65D 45/10* (2006.01)

(52) U.S. Cl.
USPC ..... 220/582; 220/327

(58) Field of Classification Search
USPC ..... 220/582, 327, 622
See application file for complete search history.

(56) References Cited

U.S. PATENT DOCUMENTS 2,196,895 A * 4/1940 Bowman ..... 220/233
3,437,230 A * 4/1969 Savory ..... 220/327
3,552,789 A 1/1971 Evans
3,695,482 A * 10/1972 Smith ..... 220/328
3,934,752 A 1/1976 Ravicchio et al.
4,380,405 A 4/1983 Kaneki et al.
4,565,297 A * 1/1986 Korner et al. ..... 220/582
4,595,038 A 6/1986 Wege (Continued)

FOREIGN PATENT DOCUMENTS

GB 1 314 147 4/1973
JP 48-21804 3/1973

(Continued)

OTHER PUBLICATIONS

Ebara Catalog, Compressors, Japan, 1996, pp. 12-13.

(Continued)

*Primary Examiner* — Mickey Yu
*Assistant Examiner* — Niki Eloshway
(74) *Attorney, Agent, or Firm* — Antonelli, Terry, Stout & Kraus, LLP.

(57) ABSTRACT

Size reduction of a barrel-type casing using a shear key is aimed for while ensuring a necessary area of a head cover end surface. A shoulder is formed on the axially outer side of the outer circumferential surface of a head cover. The inner surface of a casing is provided with a circumferentially extending groove. Shear key structure includes a first shear key member disposed in the shoulder and the groove, such that at least a portion of its outer circumferential surface is in contact with the inner circumferential surface of the groove, and a second shear key member disposed adjacent to the first shear key member in the groove, the second shear key member having an axially projecting shoulder, its outer circumferential surface being in contact with an inner circumferential surface of the casing. The first and second shear key members are circumferentially segmented respectively into three or more members, and each member is radially fixed to the casing but not axially fastened to each other, to allow slight displacement between the first and second shear key members by a shear force.

14 Claims, 5 Drawing Sheets

(56) References Cited

U.S. PATENT DOCUMENTS

| | | | | |
|---|---|---|---|---|
| 5,429,268 | A * | 7/1995 | Hale et al. | 220/582 |
| 5,908,134 | A * | 6/1999 | Hale et al. | 220/582 |
| 2007/0175904 | A1* | 8/2007 | Meindl et al. | 220/582 |
| 2009/0324404 | A1* | 12/2009 | Maier et al. | 415/214.1 |
| 2010/0181325 | A1* | 7/2010 | Jenkins et al. | 220/586 |

FOREIGN PATENT DOCUMENTS

| | | |
|---|---|---|
| JP | 49-37932 | 10/1974 |
| JP | 53-136465 | 10/1978 |
| JP | 55-125398 | 9/1980 |
| JP | 56-17399 | 2/1981 |
| JP | 56-104199 | 8/1981 |
| JP | 58-079700 | 5/1983 |
| JP | 58-149465 | 9/1983 |

OTHER PUBLICATIONS

GE Oil & Gas, Centrifugal & Axial Compressors, Nov. 2005, pp. 3-27.

Notice of Reasons for rejection of JP Appln. No. 2009-103744 dated Mar. 12, 2013 in English.

Notice of Reasons for rejection of JP Appln. No. 2009-103744 dated Mar. 12, 2012 in English.

JP Office Action of Appln. No. 2009-103744 dated Mar. 12, 2013.

* cited by examiner

END WALL CLOSURE APPARATUS

BACKGROUND OF THE INVENTION

The present invention relates to a mounting structure of a head cover on a barrel-type apparatus used for a casing of a turbo machine or the like or a pressure vessel, to a vessel or a casing having the mounting structure, and also a centrifugal compressor housed in the casing.

As a structure to fix a head cover of a centrifugal compressor, a bolted structure as shown in FIG. 1 of JP Published Patent Application No. 55-125398 A (1980) is most frequently used. In the bolted structure, however, it is necessary to increase the number of bolts as the pressure inside a casing increases. Thus, there is a problem that assembling and disassembling operations become complicated and the bolted structure increases in cost.

To solve the problem, a shear key structure as shown in FIG. 5 of JP Examined Patent Application Publication No. 49-37932 B (1974) or the like is used in the high-pressure casing. In the structure, a shear key having a smaller inner diameter than that of a groove provided in a casing is mounted on the groove, and a head cover is thereby fixed to the casing. Some improvements of the shear key structure have been proposed.

According to FIG. 3 of JP Published Patent Application No. 55-125398 A (1980), a ring-shaped stopper for radially fixing the shear key is provided on the inner diameter side of the shear key, to thereby restrict the rotation of the shear key. Meanwhile, according to FIG. 6 of JP Published Patent Application No. 55-125398 A (1980), the shear key is provided with a shoulder, in addition to the ring-shaped stopper structure, and the outer diameter of the shoulder is brought into contact with the inner diameter of the casing, to thereby reduce a force applied to the shear key.

According to FIG. 1 of U.S. Pat. No. 3,934,752, the shear key is axially segmented into two members, with respect to the shear key structure shown in FIG. 5 of JP Examined Patent Application Publication No. 49-37932 B (1974). According to FIG. 3 of JP Examined Patent Application Publication No. 49-37932 B (1974), instead of a shoulder of the head cover in the structure shown in FIG. 1 of U.S. Pat. No. 3,934,752, the shear key is segmented into two members and its axially inner side member is provided with a shoulder. According to FIG. 1 of JP Published Patent Application No. 48-21804 A (1973), an axially outer side one of the shear key members segmented into two is also provided with a shoulder, the outer diameter of the shoulder is disposed in contact with the inner diameter of the casing, and the two shear keys are fixed by using bolts.

BRIEF SUMMARY OF THE INVENTION

As described above, the bolted structure has been most frequently used as a closure structure for a barrel-type casing of a turbo machine such as a centrifugal compressor. However, as the pressure increases, it is necessary to increase the number of bolts, causing trouble that assembling and disassembling operations become complicated, resulting in cost increase.

To solve the problem, the shear key has been conventionally used in the high-pressure casing. In the shear key structure as shown in FIG. 5 of JP Examined Patent Application Publication No. 49-37932 B (1974), axial load due to an internal pressure and also a force from the casing that supports the axial load act on the cross-sectional center of gravity of the shear key with a distance vertically away from the rotating axis, and thus generate a rotation moment on the shear key. The shear key rotates due to the moment, and stops by unevenly contacting the casing at two points. Such unevenly contacting produces a locally high surface pressure that causes a problem that the casing, the shear key and the head cover are subject to plastic deform.

To solve the problem, the shear key structure of a moment balancing method has been known. An example of the moment balancing shear key structure includes the structure provided with a ring-shaped stopper as shown in FIGS. 3 and 6 of JP Published Patent Application No. 55-125398 A (1980). The structure, however, has a problem that the end surface of the head cover reduces in area and has difficulties in ensuring an area large enough to mount a flange for introducing a fluid that is required for a bearing, a shaft seal or the like.

According to the shear key structure as shown in FIG. 1 of U.S. Pat. No. 3,934,752, FIG. 3 of JP Examined Patent Application Publication No. 49-37932 B (1974) and FIG. 1 of JP Published Patent Application No. 48-21804 A (1973), it is possible to ensure large area for the end surface of the head cover. However, according FIG. 1 of U.S. Pat. No. 3,934,752, a load is concentrated to the axially inner side member of the shear key, so that the member has increased dimensions, and the groove provided in the casing is extended, causing problem that the entire casing is extended.

According to the shear key structure as shown in FIG. 3 of JP Examined Patent Application Publication No. 49-37932 B (1974), and FIG. 1 of JP Published Patent Application No. 48-21804 A (1973), the axially inner side member of the shear key is provided with a shoulder to thereby reduce the load on the member. However, since the structure of the axially inner side member of the shear key becomes complicated, the machining thereof also becomes complicated, and higher machining accuracy is required. In addition, a bending stress occurs on the shoulder, so that the shoulder may be deformed or destroyed. Thus, there is a problem that the shoulder needs to be carefully designed.

According to the shear key structure as shown in FIG. 1 of JP Published Patent Application No. 48-21804 A (1973), the axially outer side member of the shear key segmented into two members is also provided with a shoulder, to thereby reduce the load applied to the axially inner side shear key member. However, as a shear force is applied to the bolt that fastens the axially segmented shear key members, the bolt may be broken and the load share between the segmented shear key members is not clear. Thus, there presents a problem that the shear key structure has to be designed on the safe side, with the result that the casing increases in size.

The present invention has been made to solve the aforementioned problems of the conventional art.

In order to solve the aforementioned problems, a pressure vessel according to the present invention comprises a casing, a head cover mounted on the casing, and a shear key arranged between the casing and the head cover, wherein an inner surface of the casing is provided with a circumferentially extending groove, a plurality of shear key members are axially and circumferentially disposed in the groove to prevent the head cover from moving axially outward, and the plurality of shear key members are individually fixed to the casing only in a radial direction, so as to allow the shear key members to be displaced from each other in the radial direction.

Another pressure vessel according to the present invention comprises a casing, a head cover mounted on the casing, and shear keys arranged between the casing and the head cover, wherein a shoulder is formed on the axially outer side of an outer circumferential surface of the head cover; an inner surface of the casing is provided with a circumferentially extending groove; a first shear key member is disposed in the groove and the shoulder, such that at least a portion of an outer circumferential surface of the first shear key member is in contact with an inner circumferential surface of the groove; a second shear key member is disposed adjacent to the first shear key member in the groove, the second shear key member having an axially projecting shoulder, a radially outer circumferential surface thereof being in contact with an inner circumferential surface of the casing; and each of the first and second shear key members is circumferentially segmented into three or more members, each of the members being radially fixed to the casing but not axially fastened to each other, so as to allow radially slight displacement between the first and the second shear key members by a shear force acting therebetween.

According to the present invention, the shear key structure can be designed small. Particularly, the high-pressure casing can be downsized.

DESCRIPTION OF SYMBOLS

Figure 1:
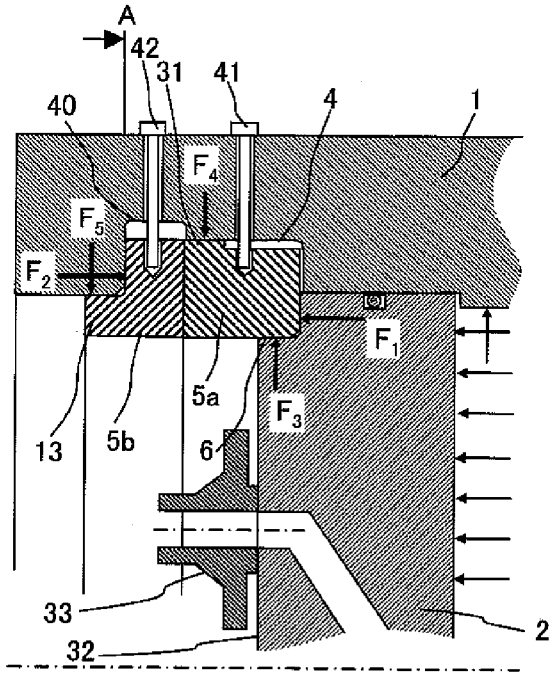
FIG. 1 shows a shear key structure according to Embodiment 1.

1: Casing
2: Head cover
4: Groove
5*a*: First shear key member
5*b*: Second shear key member
6: Shoulder
7: Stopper
13: Shoulder
21: Impeller
22: Shaft
23: Inner casing
31: Projecting part
32: End surface
33: Flange
40: Joggled groove
41: Bolt
42: Bolt
57: Segmented surface
58: Segmented surface
59: Inlet
60: Outlet

DETAILED DESCRIPTION OF THE INVENTION

In the following, embodiments will be described with reference to the drawings.

Figure 7:
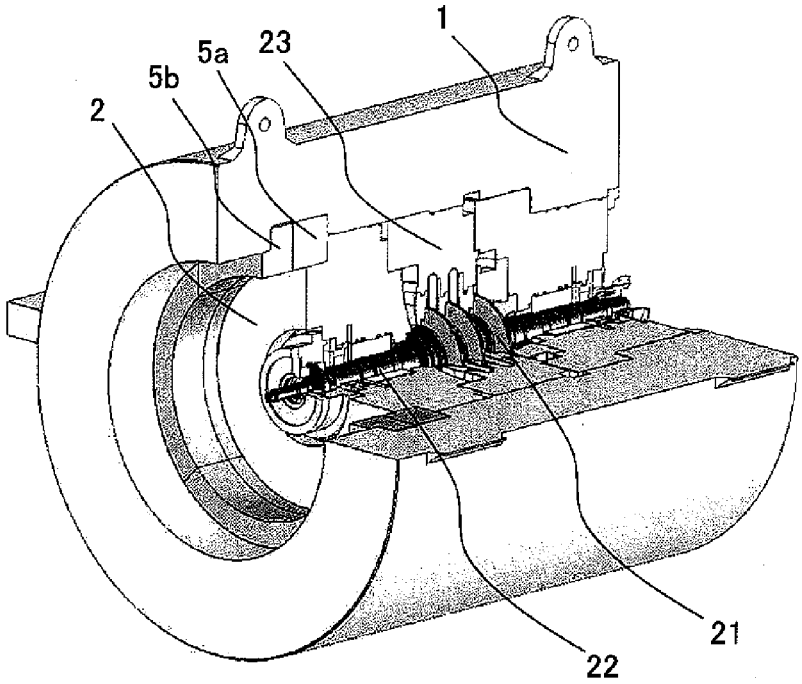
FIG. 7 shows a cut model of the entire structure of a multistage centrifugal compressor using the shear key structure according to the Embodiment 1.
Figure 8:
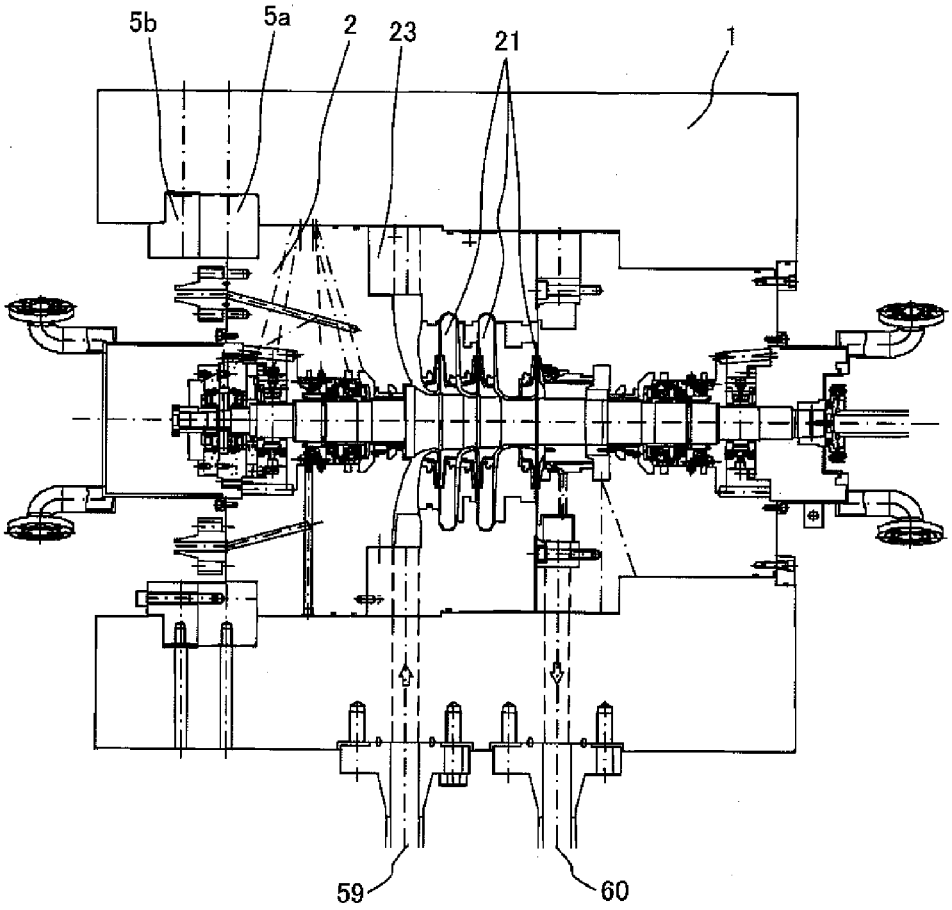
FIG. 8 is a sectional view of the entire multistage centrifugal compressor using the shear key structure according to the Embodiment 1.

First, a centrifugal compressor will be described based on FIGS. 7 and 8, which show a multistage centrifugal compressor having a structure that a rotating body having a plurality of impellers 21 and a shaft 22, and an inner casing 23 having a fluid path through which an inhaled gas flows are axially inserted into a cylindrical barrel-type casing 1, and the barrel-type casing 1 is closed by a head cover 2. Since the rotating body having the impellers 21 and the shaft 22, and the inner casing 23 are axially inserted into the casing 1, at least one side of the casing 1 in the axial direction is in an open state. The side is sealed by the head cover 2. The centrifugal compressor inhales a gas from an inlet 59, compresses the gas by the impellers 21, and discharges the gas from an outlet 60. That is, the centrifugal compressor includes the inlet 59 for inhaling a gas, the rotating body having the plurality of impellers 21 and the shaft 22, the inner casing 23 having the fluid path through which flows the gas inhaled from the inlet 59, and the outlet 60 for discharging the gas compressed by the rotation of the rotating body.

FIG. 1 shows a shear key structure according to Embodiment 1. A groove 4 is formed in the inner surface of the barrel-type casing 1 at a position where the head cover 2 is mounted. Meanwhile, a shoulder 6 is formed in the outer circumferential surface of the head cover 2 on the axially outer side. A first key member 5*a* segmented into three or more members in the circumferential direction is disposed in a combined manner in the shoulder 6. The first key member 5*a* has its outer diameter surface contacting the circumferential surface of the groove of the casing, its inner diameter surface contacting the outer diameter surface of the shoulder of the head cover, and its axial end surface contacting the axial end surface (the radially extending surface) formed in the shoulder of the head cover. That is, the first key member 5*a* is fixed to the shoulder 6 of the head cover 2 in both the radial direction and the axial direction. A projecting part 31 may be also provided on a portion of the outer diameter surface of the first key member 5*a* on the axially outer side.

A second key member 5*b* is also arranged in the groove 4 formed in the inner surface of the barrel-type casing 1 so as to be in contact with the first key member 5*a*. The outer diameter of the second key member 5*b* is smaller than the diameter of the circumferential surface of the groove 4, and is larger than the inner diameter of the casing 1. The inner diameter of the second key member 5*b* is equal to the diameter of the shoulder 6 of the head cover 2. The second key member 5*b* is segmented into three or more members in the circumferential direction, and has a shoulder 13 having an L shape in section along the axis. The outer diameter of the shoulder 13 is equal to the inner diameter of the casing 1.

The second key member 5*b* is disposed adjacent to the axially outer side of the first key member 5*a* in the groove 4 formed in the inner surface of the barrel-type casing 1. At this point, the first and second key members 5*a* and 5*b* are not fastened to each other in the axial direction, but are fixed to the casing 1 using bolts 41 and 42. The outer diameter of the shoulder 13 is thereby in contact with the inner circumferential surface of the casing 1.

According to the embodiment shown in FIG. 1, female threads are formed in the first and second key members 5*a* and 5*b*, and the bolts 41 and 42 are inserted into holes provided in the casing 1, to thereby pull the first and second key members 5*a* and 5*b* in the centrifugal direction. Alternatively, the first and second key members 5*a* and 5*b* may be also fixed by making holes in the first and second key members 5*a* and 5*b*, forming female threads in the groove 4 of the casing 1, and inserting the bolts into the first and second key members 5*a* and 5*b* from the inner diameter side.

The groove 4 of the casing 1 includes a joggled groove 40 having a larger diameter at a position where the second key member 5*b* having an L shape in section is arranged than that of a portion of the groove 4 where the first key member 5*a* is mounted in contact with the head cover.

Figure 3:
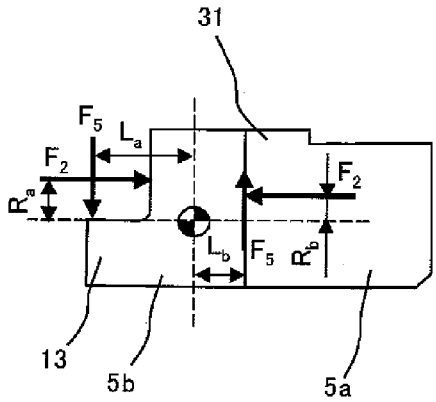
FIG. 3 shows forces acting on a second key member according to the Embodiment 1.
Figure 6:
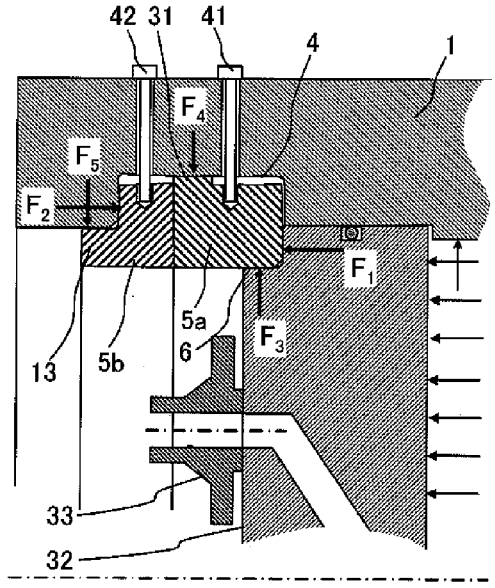
FIG. 6 shows a shear key structure according to Embodiment 2.

In the shear key structure shown in FIG. 1, the head cover 2 can ensure a larger end surface 32 than that of a conventional shear key structure shown in FIG. 3 of JP Published Patent Application No. 55-125398 A (1980) and FIG. 6 of JP Published Patent Application No. 55-125398 A (1980), because of the first and second key members 5*a* and 5*b* which are axially segmented. According to a conventional shear key structure shown in FIG. 1 of U.S. Pat. No. 3,934,752, the load is intensively applied to a member corresponding to the member 5*a* in the Embodiment 1, to increase the dimensions of the member. However, according to the shear key structure shown in FIG. 1, the load is shared by the shoulder 13 of the second key member 5*b*, so that the first key member 5*a* can be reduced in size.

According to a shear key structure shown in FIG. 3 of JP Examined Patent Application Publication No. 49-37932 B (1974), and FIG. 1 of JP Published Patent Application No. 48-21804 A (1973), a shoulder is provided in a member corresponding to the member 5*a* in the Embodiment 1 shown in FIG. 1. Since the shoulder is not provided therein in the shear key structure shown in FIG. 1, the aforementioned problem with respect to the shear key structure shown in FIG. 3 of JP Examined Patent Application Publication No. 49-37932 B (1974), and FIG. 1 of JP Published Patent Application No. 48-21804 A (1973), that is, the problem that high design and machining accuracy is required to prevent the shoulder from being deformed or destroyed can be avoided.

In the shear key structure shown in FIG. 1, the first and second key members 5*a* and 5*b* are not fastened to each other in the axial direction, but are fixed to the casing 1 in the radial direction. Also, the portion 40 for housing the second key member 5*b* is made deeper than another portion of the groove 4 of the casing 1, so that the second key member 5*b* is not in contact with the groove bottom portion 40.

Figure 2:
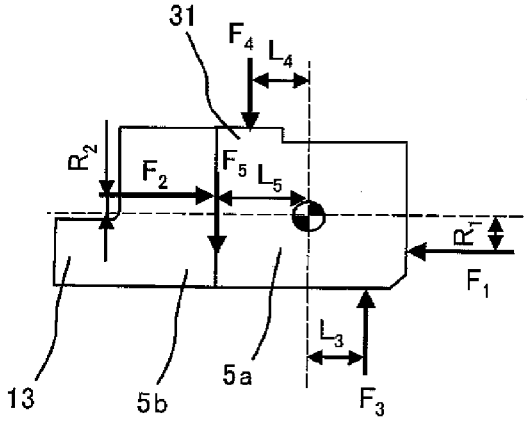
FIG. 2 shows forces acting on a first key member according to the Embodiment 1.

FIG. 2 shows forces acting on the first key member 5*a* in the shear key structure shown in FIG. 1, and FIG. 3 similarly shows forces acting on the second key member 5*b*. FIG. 3 shows the distribution of the amount of slip between the first and second key members 5*a* and 5*b*.

When an internal pressure is applied to the casing 1 and the head cover 2, a compressive surface pressure is applied to a contact surface between the first and second key members 5*a* and 5*b* by a force $F_1$ from the head cover 1 and an equivalent force $F_2$ from the casing 1. Meanwhile, a clockwise moment is generated on the first key member 5*a* as shown in FIG. 2 due to the forces $F_1$ and $F_2$. The moment balances with a moment in the opposite direction due to a resistance $F_3$ of the inner circumferential surface of the head cover 2, a resistance $F_4$ of the circumferential surface of the groove 4 of the casing 1 (the radial contact surface), and a friction $F_5$ generated between the first and second key members 5*a* and 5*b*. That is, the next expression is obtained.

$$F_1=F_2 \tag{1}$$

$$F_3=F_4+F_5 \tag{2}$$

$$F_1R_1+F_2R_2=F_3L_3+F_4L_4+F_5L_5 \tag{3}$$

Meanwhile, a force shown in FIG. 3 is applied to the second key member 5*b*. That is, the next expression is obtained.

$$F_2R_a-F_2R_b-F_5L_a-F_5L_b=0 \tag{4}$$

At this point, a force $F_5$ applied to the shoulder 13 of the second key member 5*b* is equal to or less than a stiction acting between the first and second key members 5*a* and 5*b*. When a coefficient of friction between the first and second key members 5*a* and 5*b* is represented by μ, the stiction acting between both the members is represented by $\mu F_1$. When the stiction $\mu F_1$ is large and no slip occurs between the first and second key members 5*a* and 5*b*, the force $F_4$ generated on the circumferential surface of the groove 4 of the casing 1 (the radial contact surface) becomes 0.

According to the conventional shear key structure shown in FIG. 1 of JP Published Patent Application No. 48-21804 A (1973), members corresponding to the first and second key members 5*a* and 5*b* in the Embodiment 1 shown in FIG. 1 are axially fixed using a bolt. A fastening force of the bolt is much smaller than the force $F_1$ from the head cover even when the bolt includes a plurality of bolts disposed in the circumferential direction. Also, slip occurs between the first and second key members 5*a* and 5*b* as described below. Thus, the problem that the bolt used to axially fasten the members is broken or suffers from fatigue breakdown may occur.

Figure 4:
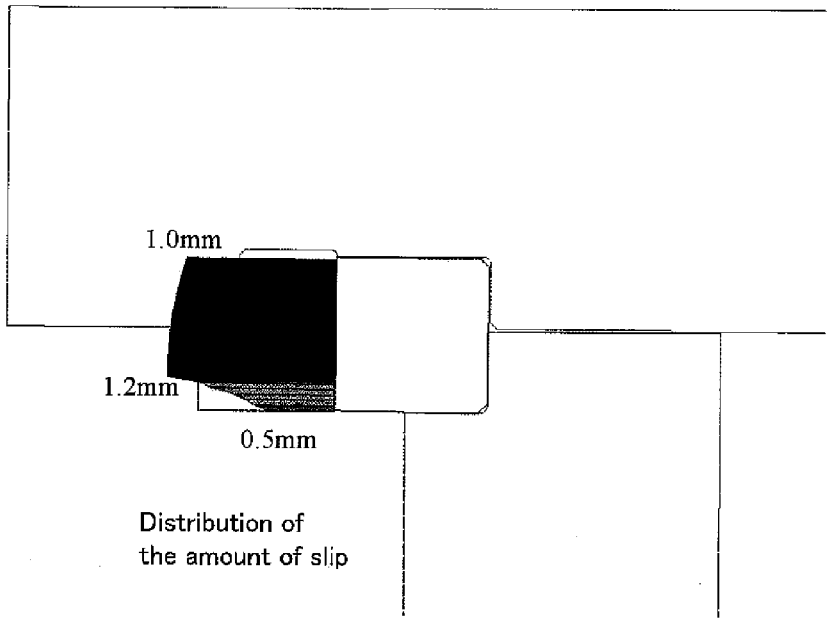
FIG. 4 shows the amount of slip between the first and second key members according to the Embodiment 1.

FIG. 4 shows the distribution of the amount of slip between the first and second key members 5*a* and 5*b* in the shear key structure according to the Embodiment 1 shown in FIG. 1 calculated by finite element analysis. Here, it is assumed that μ=0.3 as a general coefficient of friction between metal materials. FIG. 4 shows that a slip of over 1.0 mm occurs over a wide region between the first and second key members 5*a* and 5*b*.

In the Embodiment 1, the structure that the first and second key members 5*a* and 5*b* are not axially fixed, but are radially fixed to the casing 1 using the bolts 41 and 42 is employed. Accordingly, the slip between both the members is tolerated. The force $F_5$ applied to the shoulder 13 of the second key member 5*b* is calculated by the next expression from the coefficient of friction μ between the first and second key members 5*a* and 5*b*.

$$F_5=\mu F_1 \tag{5}$$

The load on each portion can be obtained from the dimensions of each portion by using the aforementioned expressions (1) to (5). Accordingly, the first and second key members 5*a* and 5*b* can be designed appropriately with respect to the load, so that the first and second key members 5*a* and 5*b* can be reduced in size, and resultantly, the groove 4 and the casing 1 can be also reduced in size.

Figure 5:
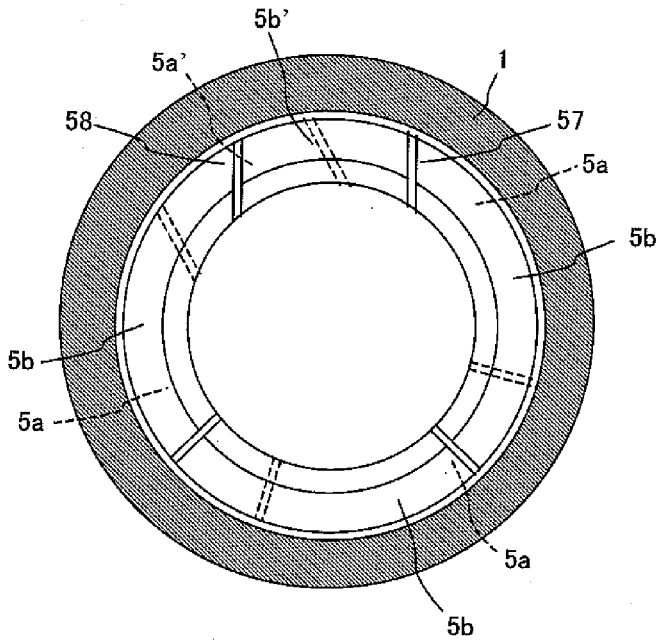
FIG. 5 shows a cut plane along the line A in FIG. 1 as viewed in the direction of the arrow.

FIG. 5 shows a cut plane along the line A of the casing 1 in FIG. 1 as viewed in the direction of the arrow. A portion indicated by the solid line represents the second key member 5*b* on the front side, and a portion indicated by the dashed line represents the first key member 5*a* on the back side. Both the members preferably do not overlap with each other at the circumferentially segmented positions.

In the shear key structure according to the Embodiment 1, it is necessary to bring the outer diameter of the first key member 5*a* into contact with the groove 4 of the casing 1, but not to bring the outer diameter of the second key member 5*b* into contact with the groove 4 of the casing 1. To this end, the joggled groove 40 may be formed by increasing the groove depth at the position where the second key member 5*b* is arranged. Since the load $F_2$ in the shear key structure is very large, a large contact area is required between the second key member 5*b* and the axial end surface of the groove 4. Since a large contact area is also required between the first and second key members 5*a* and 5*b*, the outer diameters of both the members are preferably equal to each other. Therefore, the groove of the casing 1 preferably includes the joggled groove 40.

FIG. 6 shows Embodiment 2. Although the Embodiment 2 is not different from the Embodiment 1 in that the shear key structure having the first and second key members 5*a* and 5*b* is provided, the outer diameter of the second key member 5*b* is slightly smaller than the diameter of the inner circumferential surface of the groove 4 of the casing 1 to prevent the outer diameter of the second key member 5*b* from contacting the inner circumferential surface of the groove 4.

As described above, the bolts are used to fix the first and second key members 5*a* and 5*b* to the casing 1 in both the Embodiments 1 and 2. However, the fixing means is not limited to the bolt, and another fixing means may be appropriately employed.

The present invention can be widely applied to a cover mounting structure of not only a turbo machine such as a centrifugal compressor, but also various pressure vessels and casings.

What is claimed is:

1. A pressure vessel or a casing apparatus comprising a casing, a head cover, and a shear key mounting the head cover on the casing, wherein an inner surface of the casing is provided with a circumferentially extending groove, the shear key is axially segmented into a plurality of shear key members and is circumferentially segmented into a plurality of shear key members, the plurality of shear key members are axially and circumferentially disposed in the groove to prevent the head cover from moving axially outward, and each of the plurality of shear key members is fastened to the casing in a radial direction by a respective fastener penetrating the shear key member.

2. The pressure vessel or a casing apparatus according to claim 1, wherein the shear key is axially segmented into at least a first shear key member and a second shear key member, the first shear key member being circumferentially segmented into a plurality of members, and the second shear key member being circumferentially segmented into a plurality of members.

3. The pressure vessel or a casing apparatus according to claim 1, wherein each of the plurality of shear key members is individually fastened to the casing in a radial direction by a fastener connected to the shear key member and the casing.

4. The pressure vessel or a casing apparatus according to claim 3, wherein the fastener is a bolt.

5. The pressure vessel or a casing apparatus according to claim 1, wherein each of the plurality of shear key members is circumferentially segmented into three or more portions, each of the portions being fastened to the casing by at least one respective fastener penetrating the shear key member.

6. A pressure vessel or a casing apparatus comprising a casing, a head cover, and a shear key mounting the head cover on the casing, wherein a shoulder is formed on the axially outer side of an outer circumferential surface of the head cover;

an inner surface of the casing is provided with a circumferentially extending groove;

the shear key is axially segmented into a first shear key member and a second shear key member;

the first shear key member is disposed in the groove and the shoulder, such that at least a portion of an outer circumferential surface of the first shear key member is in contact with an inner circumferential surface of the groove;

the second shear key member is disposed adjacent to the first shear key member in the groove, the second shear key member having an axially projecting shoulder, a radially outer circumferential surface thereof being in contact with an inner circumferential surface of the casing; and each of the first and second shear key members is circumferentially segmented into three or more members, each of the members being radially fastened to the casing but not axially fastened to each other, so as to allow radially slight displacement between the first and the second shear key members by a shear force acting therebetween.

7. The pressure vessel or casing apparatus according to claim 6, wherein the groove of the casing is joggled such that an inner diameter of a part of the groove, where the second shear key member is disposed, is larger than a diameter of an outer circumferential surface of the second shear key member.

8. The pressure vessel or casing apparatus according to claim 6, wherein a diameter of an outer circumferential surface of the second shear key member is smaller than a diameter of the outer circumferential surface of the first shear key member.

9. The casing apparatus according to claim 5, wherein a turbo machine is housed.

10. The casing apparatus according to claim 9, wherein said turbo machine is a centrifugal compressor.

11. A centrifugal compressor housed in a casing apparatus according to claim 10.

12. The pressure vessel or a casing apparatus according to claim 6, wherein each of the three or more members of the first shear key member and each of the three or more members of the second shear key member is individually fastened to the casing only in a radial direction by a fastener connected to the member and the casing.

13. The pressure vessel or a casing apparatus according to claim 12, wherein the fastener is a bolt.

14. A pressure vessel or a casing apparatus comprising a casing, a head cover, and shear key members mounting the head cover on the casing, wherein a shoulder is formed on the axially outer side of an outer circumferential surface of the head cover;

an inner surface of the casing is provided with a circumferentially extending groove;

a first shear key member is disposed in the groove and the shoulder, such that at least a portion of an outer circumferential surface of the first shear key member is in contact with an inner circumferential surface of the groove;

a second shear key member is disposed adjacent to the first shear key member in the groove, the second shear key member having an axially projecting shoulder, a radially outer circumferential surface thereof being in contact with an inner circumferential surface of the casing;

the first shear key member is fastened to the casing in a radial direction by a first fastener penetrating the first shear key member;

the second shear key member is fastened to the casing in a radial direction by a second fastener penetrating the second shear key member; and each of the first and second shear key members is circumferentially segmented into three or more portions, each of the portions being radially fastened to the casing.

* * * * *